US008065140B2

(12) United States Patent
Sakurai et al.

(10) Patent No.: US 8,065,140 B2
(45) Date of Patent: Nov. 22, 2011

(54) METHOD AND SYSTEM FOR DETERMINING PREDOMINANT FUNDAMENTAL FREQUENCY

(75) Inventors: Atsuhiro Sakurai, Ibaraki (JP); Steven David Trautmann, Ibaraki (JP)

(73) Assignee: Texas Instruments Incorporated, Dallas, TX (US)

( * ) Notice: Subject to any disclaimer, the term of this patent is extended or adjusted under 35 U.S.C. 154(b) by 779 days.

(21) Appl. No.: 12/185,800

(22) Filed: Aug. 4, 2008

(65) Prior Publication Data

US 2009/0063138 A1 Mar. 5, 2009

Related U.S. Application Data

(60) Provisional application No. 60/969,067, filed on Aug. 30, 2007.

(51) Int. Cl.
*G10L 19/00* (2006.01)

(52) U.S. Cl. ..... 704/217; 704/205; 704/207; 375/241

(58) Field of Classification Search ..... 704/205, 704/207, 217; 375/241
See application file for complete search history.

(56) References Cited

U.S. PATENT DOCUMENTS

| | | | | |
|---|---|---|---|---|
| 7,529,661 | B2 * | 5/2009 | Chen | 704/216 |
| 7,752,037 | B2 * | 7/2010 | Chen | 704/207 |
| 2006/0080088 | A1 * | 4/2006 | Lee et al. | 704/207 |
| 2006/0095256 | A1 * | 5/2006 | Nongpiur et al. | 704/207 |

OTHER PUBLICATIONS

Tolonen, Tero, and Karjalainen, Matti, "A Computationally Efficient Multipitch Analysis Model," IEEE Transactions on Speech and Audio Processing, vol. 8, No. 6, Nov. 2000, pp. 708-716.
L.R. Rabiner, et al., "A Comparative Performance Study of Several Pitch Detection Algorithms," IEEE Trans. on Acoustics, Speech, and Signal Processing, vol. ASSP-24, No. 5, Oct. 1976, pp. 399-418.
H. Indefrey, et al., "Design and Evaluation of Double-Transform Pitch Determination Algorithms With Nonlinear Distortion in the Frequency Domain—Preliminary Results," Proc. ICASSP'85, 1985, pp. 415-418.
F.J. Charpentier, "Pitch Detection Using the Short-Term Phase Spectrum," Proc. ICASSP'86, 1986, pp. 113-116.
H. Kawahara, et al., "Restructuring speech representations using STRAIGHT-TEMPO: Possible role of a repetitive structure in sounds," Proc. the Second IJCAI Workshop on Computational Auditory Scene Analysis (CASA-97), 1997, pp. 103-112.
S. Roucos and A.M. Wilgus, "High Quality Time Scale Modification for Speech," Proc. ICASSP'85, 1985, pp. 493-496.
P. Wong and O. Au, "Fast SOLA-Based Time Scale Modification Using Modified Envelope Matching", Proc. ICASSP'02, 2002, 3188-3191.
A. Sakurai, Generalized Envelope Matching Technique for Time-Scale Modification of Speech (GEM-TSM), Proc. of Interspeech'2005, Sep. 2005, pp. 3309-3312.

* cited by examiner

*Primary Examiner* — Daniel D Abebe
(74) *Attorney, Agent, or Firm* — Mima Abyad; Wade J. Brady, III; Frederick J. Telecky, Jr.

(57) ABSTRACT

Methods, digital systems, and computer readable media are provided for determining a predominant fundamental frequency of a frame of an audio signal by finding a maximum absolute signal value in history data for the frame, determining a number of bits for downshifting based on the maximum absolute signal value, computing autocorrelations for the frame using signal values downshifted by the number of bits, and determining the predominant fundamental frequency using the computed autocorrelations.

20 Claims, 3 Drawing Sheets

METHOD AND SYSTEM FOR DETERMINING PREDOMINANT FUNDAMENTAL FREQUENCY

CROSS-REFERENCE TO RELATED APPLICATIONS

This application claims priority from Provisional Application No. 60/969,067, filed Aug. 30, 2007. The following co-assigned, co-pending patent application discloses related subject matter: U.S. patent application Ser. No. 12/185,787, entitled Method and System for Music Detection (TI-63573), filed 08/04/2008.

BACKGROUND

Fundamental frequency (F0) estimation, also referred to as pitch detection, is an important component in a variety of speech processing systems, especially in the context of speech recognition, synthesis, and coding. The basic problem in fundamental frequency (F0) estimation is extraction of the fundamental frequency (F0) from a sound signal. The fundamental frequency (F0) is usually the lowest frequency component, or partial, which relates well to most of the other partials. In a periodic waveform, most partials are harmonically related, meaning that the frequencies of most of the partials are related to the frequency of the lowest partial by a small whole-number ratio. The frequency of this lowest partial is the fundamental frequency (F0) of the waveform.

Approaches to fundamental frequency (F0) estimation typically fall in one of three broad categories: approaches that principally utilize the time-domain properties of an audio signal, approaches that principally utilize the frequency-domain properties of an audio signal, and approaches that utilize both the frequency-domain and time-domain properties. In general, time-domain approaches operate directly on the audio waveform to estimate the pitch period. Peak and valley measurements, zero-crossing measurements, and autocorrelation measurements are the measurements most commonly used in the time-domain approaches. The basic assumption underlying these measurements is that simple time-domain measurements will provide good estimates of the period if a quasi-periodic signal is suitably processed to minimize the effects of the formant structure.

In general, frequency-domain approaches are based on the property that when an audio signal is periodic in the time domain, the frequency spectrum of the signal will consist of a series of impulses at the fundamental frequency and its harmonics. Thus, simple measurements can be made on the frequency spectrum of the signal (or a nonlinearly transformed version of the signal) to estimate the period of the signal. Further, approaches based on frequency-domain processing perform relatively well for non-speech audio signals as such signals do not require spectral flattening. However, these approaches are easily influenced by the presence of low-energy tonal components that are difficult to separate in the frequency domain. Moreover, they may be computation intensive.

The hybrid approaches may incorporate features of both time-domain and frequency-domain approaches. For example, a hybrid approach may use frequency-domain techniques to provide a spectrally flattened time waveform and then apply autocorrelation measurements to estimate the pitch period. More specifically, the autocorrelation of a spectrum-flattened signal is calculated where spectral flattening may be performed using, for example, cepstrum or LPC analysis, or by means of non-linear processing. The peaks of the autocorrelation function are separated by an amount that is approximately equal to the fundamental period. Hybrid approaches perform relatively well for clean speech but performance tends to degrade for speech corrupted by noise, speech mixed with music, and most types of music signals.

SUMMARY

Embodiments of the invention provide methods and system for determination of the predominant fundamental frequency in frames of audio signals in which autocorrelation is used in conjunction with adaptively downshifted data.

BRIEF DESCRIPTION OF THE DRAWINGS

Particular embodiments in accordance with the invention will now be described, by way of example only, and with reference to the accompanying drawings.

DETAILED DESCRIPTION

Figure 1:
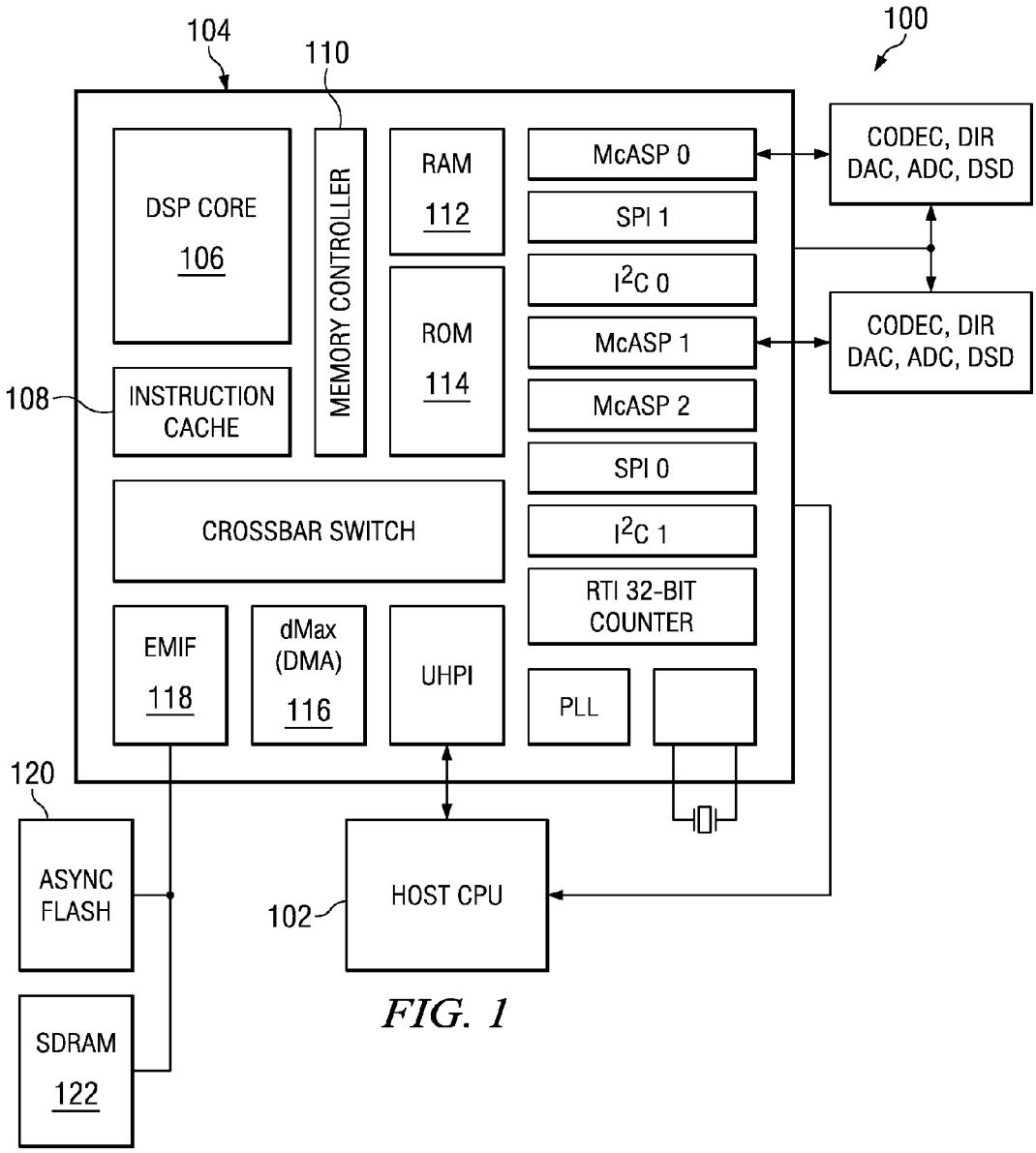
FIG. 1 shows a block diagram of an illustrative digital system in accordance with one or more embodiments of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description. In addition, although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

In general, embodiments of the invention provide methods and systems for predominant fundamental frequency determination in audio signals. More specifically, embodiments of the invention provide for determining the predominant fundamental frequency contour of an audio signal using dynamic envelope autocorrelation. A predominant fundamental frequency may be defined as the fundamental frequency of the most important component of an audio signal mixture (containing music, speech, noise, etc.). As is explained in more detail below, dynamic envelope autocorrelation is a modified autocorrelation approach based on a signal envelope that is obtained by dynamically suppressing low-energy components of an audio signal. Tonal low-energy components in an audio signal may affect the result of autocorrelation and thus suppression of such components results in improved robustness. Predominant fundamental frequency contours may be used for classification purposes, notably for automatic classification of music genres, speech formant detection, etc.

Embodiments of methods for predominant fundamental frequency determination described herein may be performed on many different types of digital systems that incorporate audio processing, including, but not limited to, portable audio players, cellular telephones, AV, CD and DVD receivers, HDTVs, media appliances, set-top boxes, multimedia speakers, video cameras, digital cameras, and automotive multimedia systems. Such digital systems may include any of several types of hardware: digital signal processors (DSPs), general purpose programmable processors, application specific circuits, or systems on a chip (SoC) which may have multiple processors such as combinations of DSPs, RISC processors, plus various specialized programmable accelerators.

FIG. 1 is an example of one such digital system (100) that may incorporate the methods for predominant fundamental frequency determination as described below. Specifically, FIG. 1 is a block diagram of an example digital system (100) configured for receiving and transmitting audio signals. As shown in FIG. 1, the digital system (100) includes a host central processing unit (CPU) (102) connected to a digital signal processor (DSP) (104) by a high speed bus. The DSP (104) is configured for multi-channel audio decoding and post-processing as well as high-speed audio encoding. More specifically, the DSP (104) includes, among other components, a DSP core (106), an instruction cache (108), a DMA engine (dMAX) (116) optimized for audio, a memory controller (110) interfacing to an onchip RAM (112) and ROM (114), and an external memory interface (EMIF) (118) for accessing offchip memory such as Flash memory (120) and SDRAM (122). In one or more embodiments of the invention, the DSP core (106) is a 32-/64-bit floating point DSP core. In one or more embodiments of the invention, the methods described herein may be partially or completely implemented in computer instructions stored in any of the onchip or offchip memories. The DSP (104) also includes multiple multichannel audio serial ports (McASP) for interfacing to codecs, digital to audio converters (DAC), audio to digital converters (ADC), etc., multiple serial peripheral interface (SPI) ports, and multiple inter-integrated circuit ($I^2C$) ports. In one or more embodiments of the invention, the methods for determining the predominant fundamental frequency described herein may be performed by the DSP (104) on frames of an audio stream after the frames are decoded.

Figure 2:
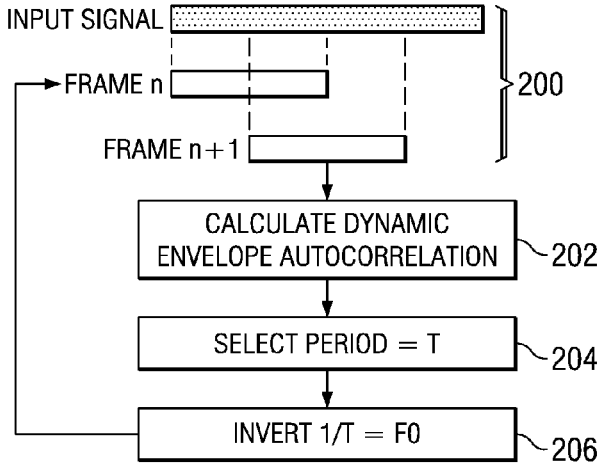
FIGS. 2 and 3 shows flow diagrams of methods for fundamental frequency determination in accordance with one or more embodiments of the invention.

FIG. 2 is a flow diagram of a method for determining the predominant fundamental frequency of each frame in an audio signal in accordance with one or more embodiments of the invention. In general, the predominant fundamental frequency for the n-th frame of an audio signal is found by searching for the local maxima of the correlation of the n-th frame with shifts of adjacent frames. More specifically, as shown in FIG. 2, initially the input audio signal is divided into overlapping frames (200). Dynamic envelope autocorrelation is performed for each frame to calculate correlation along a limited lag range. As is explained in more detail below, dynamic envelope autocorrelation is the computation of correlations from a dynamic envelope where recent absolute signal amplitude history determines bit shifting to define the dynamic envelope. For approximately periodic signals, the resulting autocorrelation curve will show peaks at multiples of harmonic periods. The maxima of the autocorrelation function are then used to obtain the fundamental period (204) and the predominant fundamental frequency is found as the inverse of the fundamental period (206).

For example, if the input audio signal, x[n], has fixed-point format (e.g., 16-bit integer data) and is partitioned into overlapping frames of length N samples with the i-th frame starting at sample iS (so the overlap of successive frames is N-S samples), and S is a fraction of N, such as in the range N/4 to 3N/4. In this example, a predominant fundamental frequency varying about 160 Hz for a sampling rate of 16 kHz would show pattern similarities roughly every 100 samples.

The conventional autocorrelation function, R(k), for a frame of a digital audio signal, x(n), with n=0, 1, N−1 is a function of the lag variable, k, is defined as:

$$R(k)=\Sigma_{0\leq n\leq L-1}x(n-k)\times(n) \tag{1}$$

where samples from L adjacent frames are used.

In addition to this conventional autocorrelation function, various cross-correlation analogs are found in the literature for use in the time-scale modification (TSM) of speech signals, e.g., synchronous overlap-add (SOLA), envelope-matching time-scale modification (EM-TSM), and generalized envelope-matching time-scale modification (GEM-TSM). In general, time scale modification adjusts the time scale for an input sequence of overlapping frames by changing the overlap (less overlap expands the time scale and more overlap compresses the time scale).

The SOLA (synchronous overlap-add) approach to TSM requires finding a position of maximum signal similarity when adjusting the frame overlap by using a normalized cross-correlation of the overlap portion between a frame of the input (analysis) signal x(n) and the time-scale modified output (synthesized) signal y(n). That is, the input analysis signal x(n) is segmented into overlapping frames of length N (e.g., N=960 samples for 20 msec frames at a 48 kHz sampling rate) which are $S_A$ samples apart thus giving an overlap of $N-S_A$ samples).

To create the n-th synthesis frame, first the normalized cross-correlation of the n-th analysis frame (which starts at sample $nS_A$ in the input stream) is computed with the overlapped portion of the synthesized signal about the target start location $nS_S$ in the output synthesis stream for the n-th synthesis frame as:

$$R'[k]=\langle y_k|x\rangle/\|y_k\|\|x\|, \tag{2}$$

where the inner product is $$\langle y_k|x\rangle=\Sigma_{0\leq j\leq L-1}y(nS_S+k+j)x(nS_A+j) \tag{3}$$

and $\|x\|$ and $\|y_k\|$ denote the corresponding norms. The summation range L is the number of samples in the overlap of the n-th analysis frame having offset (lag) k from $nS_S$ with the already-synthesized signal. The offset k may be either positive or negative. Next, the offset k in the search range which maximizes R'[k] is used to position the n-th analysis frame in the output. Lastly, the portion of the n-th analysis frame overlapping existing synthesis sample y(n) is cross-faded with y(n) and the portion extending beyond the overlap is used to define further synthesis samples y(n).

The EM-TSM approach to TSM uses a simplified envelope that considers just the sign of the signals (1-bit envelope) rather than the full cross-correlation. That is, in the normalized cross-correlation use:

$$\langle y_k|x\rangle=\Sigma_{0\leq j\leq L-1}\,\mathrm{sign}\{y(nS_S+k+j)\}\,\mathrm{sign}\{x(nS_A+j)\} \tag{4}$$

The normalization when using only the signs simplifies to division by L (which depends upon k).

A signal envelope is the signal obtained by right-shifting the original signal to remove its lowest bits. Mathematically, this is equivalent to dividing the signal amplitude by a constant. In SOLA, no such operation is performed. Therefore, the envelope is the signal itself. In EM-TSM, only the sign bit of each sample is left. That is, the EM-TSM signal envelope for a 16-bit signal is obtained by performing a 15-bit downshift, or equivalently, by dividing the amplitude by 32768. GEM-TSM, discussed below, obtains an envelope by performing a constant 11-bit downshift, which corresponds to an intermediate case between SOLA and EM-TSM.

The GEM-TSM approach to TSM takes advantage of the simplicity of EM-TSM but also includes more information in the signal envelope by using the four most significant bits (plus sign bit) of 16-bit data rather than just the sign in the cross-correlation computation. Also, GEM-TSM avoids normalization division by L by limiting the cross-correlation computation for all offsets k to the same number of terms in the summation. In particular, GEM-TSM uses one-half the overlap for offset k=0 as the cross-correlation length and centers this at the middle of the overlap. That is, with the length of the overlap denoted $L_o$, and the number of bits to shift to get the most significant bits equal to m, the cross-correlation becomes $$R_{GEM}[k]=\Sigma_{-Lo/4\leqq j\leqq Lo/4}(y(nS_S+L_o/2+k+j)>>m)(x(nS_A+L_o/2+j)>>m) \quad (5)$$

Note that typical values would be frames of length 2000-3000 samples and overlaps of 1000-2000 samples for the input analysis frames for high sampling rates such as 44.1 and 48 kHz; whereas, low sampling rates such as 8 kHz would have frames of 500-750 samples and overlaps of 250-500 samples.

As previously mentioned, dynamic envelope correlation finds a fundamental frequency for the n-th frame of an audio signal by searching for the local maxima of the correlation of the n-th frame with shifts of adjacent frames. The correlation is an envelope-modified autocorrelation function which eliminates the influence of low-energy components of the signal. Note that the analogous normalized cross-correlation function of SOLA is highly influenced by the presence of low-energy components if these components are pronouncedly tonal. Likewise, low-energy components cause a significant influence on the cross-correlation result used by the EM-TSM method because the 1-bit (sign) envelope does not include amplitude information, i.e., energy information itself is not taken into consideration. The GEM-TSM method eliminates the influence of low-energy components by using a signal envelope obtained in such a way as to suppress low-energy components while leaving enough information about the predominant signal.

Dynamic envelope correlation is based on the GEM-TSM method of correlation with two modifications: (1) the amount of amplitude compression is dynamically controlled in order to account for signal mixtures (such as speech mixed with quiet background music), and (2) the compression of negative values is not done simply by downshifting to avoid negative signs remaining intact even after a downshift amount greater than the number of bits of the sample. As previously explained, downshifting is performed in order to eliminate the influence of small signals. However, negative samples tend to retain the value −1 when the amount of shift is greater than the bit length, that is, they do not decay to 0 but to −1. Therefore, a modification is introduced to fix that behavior. Thus, the dynamic envelope autocorrelation function for the n-th frame is:

$$R_n(k)=\Sigma_{0\leqq j\leqq L-1}\{(|_nL[j+k]|>>m)\ \mathrm{sign}(x_n[j+k])\}\{(|x_n[j]|>>m)\ \mathrm{sign}(x_n[j])\} \quad (6)$$

where the signal within the calculation range and in the n-th frame is represented by vector $x_n[j]=x(nS+j)$, L is the number of points of the summation range, and $R_n(k)$ is the autocorrelation for the n-th frame and is a function of offset or lag k which is searched in a range $k_{min}\leqq k\leqq k_{max}$.

The value of L is arbitrary. It just cannot be greater than N. A smaller value of L requires a smaller number of computations but reduces accuracy. In one or more embodiments of the invention, a region located in the middle of the frame containing N/2 samples is desired, so L=N/2. The values of $k_{min}$ and $k_{max}$ depend on the expected minimum and maximum value of the fundamental period. Note that speech is expected to have fundamental frequencies in the range of 100-300 Hz, but music may have fundamental frequencies from 50 to 1000 Hz. For each value of k in the range delimited by the expected minimum and maximum value of the fundamental period, the summation R(k) is calculated. For example, if k lies between 20 and 200, R(k) is calculated for k=20, 21, 22, . . . , 200.Plotting R as a function of k would show periodic peaks, which correspond to correlation maxima. The distance between two consecutive peaks is the fundamental period.

The amount of downshift, m (i.e., divide by 2 to the m-th power by right shifting m bits), is determined dynamically from the signal according to the following equation, where max is the maximum absolute signal value found in the history data.

$$m=\text{number_of_bits}(\max)-3 \quad (7)$$

Thus, the signal amplitude is reduced in the autocorrelation computation to a 3-bit range.

The autocorrelation function (6), $R_n(k)$, yields local maxima (peaks) at the fundamental period (reciprocal of fundamental frequency) and multiples of it. Theoretically, if the maxima were always reliable, they would be a series of equally spaced peaks. In such a case, obtaining the fundamental period would be a matter of taking the distance between any two consecutive peaks. However, in practice, the obtained maxima may include outliers. Thus, in one or more embodiments of the invention, more than two maxima are considered to determine which pair of consecutive maxima represents the fundamental period. For example, if five peaks are picked for consideration, there are four possible distances between consecutive positions. If three of the four possible distances are approximately the same and one is completely different, it can safely be assumed that the different one is an outlier. The final fundamental period may be obtained based on the remaining three distances.

Thus, in some embodiments of the invention, the predominant fundamental frequency may be determined as the reciprocal of the difference between the two largest values of k where $R_n(k)$ exceeds a threshold. In one or more embodiments of the invention, the threshold is empirically defined as 0.2 times the maximum autocorrelation. More specifically, to find the fundamental period, first the maximum autocorrelation of the frame, $R_n(\mathbf{0})$, is computed. The threshold is then set as an empirically predetermined percentage of this maximum autocorrelation. In some embodiments of the invention, this predetermined percentage is twenty percent. From the selected peaks, the values of k for the two largest peaks that are not found to be outliers, $k_1$ and $k_2$, are used to compute the fundamental period as the absolute distance between the two values of k, i.e., $\mathrm{abs}(k_1-k_2)$. The predominant fundamental frequency is the reciprocal of this absolute distance.

In one or more embodiments of the invention, the predominant fundamental frequency may be determined as the reciprocal of the smallest value of k where $R_n(k)$ exceeds a threshold. More specifically, to find the fundamental period, first the maximum auto-correlation of the frame, $R_n(\mathbf{0})$, is computed. The threshold is then set as an empirically predetermined percentage of this maximum autocorrelation. Then, the first value of $R_n(k)$ that exceeds this threshold is found. A region is defined around this value and the local maximum, $k_1$, is obtained. The fundamental period is computed as the absolute difference between $k_1$ and 0, or simply $k_1$. Essentially, the process is finding the second largest peak and computing the distance relative to k=0. The predominant fundamental frequency is the reciprocal of this distance.

Figure 3:
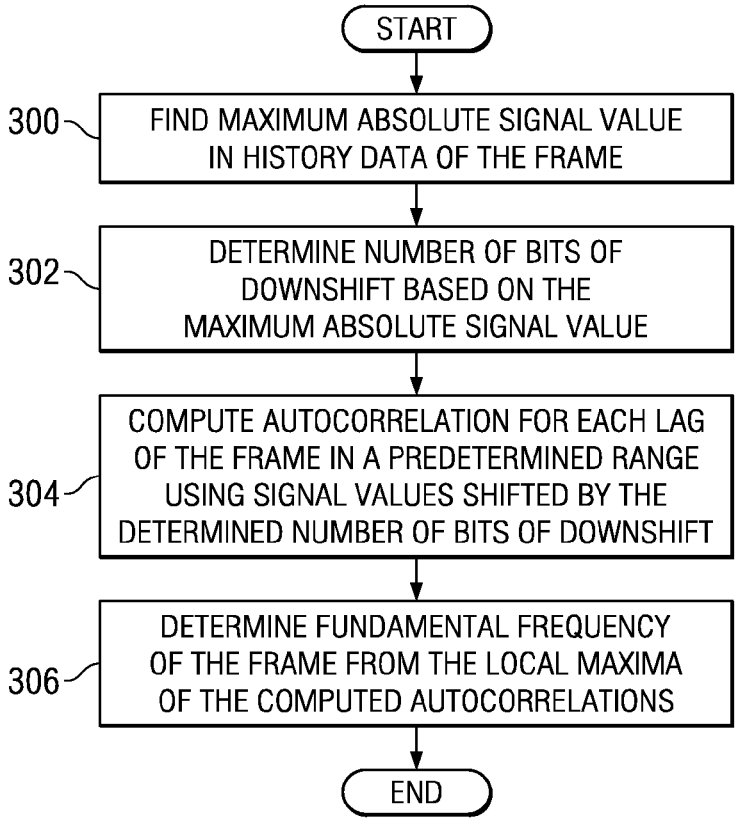

FIG. 3 shows a method for determining the fundamental frequency for a frame of an audio signal in accordance with one or more embodiments of the invention. Initially, the maximum absolute signal value is found in the history data for the frame (300). In one or more embodiments of the invention, the length of the history data may be set to 4 or 5 seconds (e.g., 100-200 frames). This maximum absolute signal value is then used to determine amount of downshift, i.e., the number of bits to shift the signal value to reduce the signal amplitude (302). Then, for each lag in a predetermined range, an autocorrelation for the frame is computed using signal values shifted by the determined amount of downshift (304). Once the autocorrelations are computed, the predominant fundamental frequency for the frame is determined from the local maxima of the autocorrelations (306). In one or more embodiments of the invention, the predominant fundamental frequency is determined as the reciprocal of the smallest lag where the autocorrelation value exceeds a predetermined threshold. In some embodiments of the invention, the predominant fundamental frequency is determined as the reciprocal of the difference between the two largest lags where the autocorrelation value exceeds a predetermined threshold.

The use of a signal envelope to calculate autocorrelation stems from the fact that signal mixtures may be expressed as a superposition of signals occupying different bit regions. In fact, high-energy signals occupy higher bits (signal envelope) while low-energy signals are contained in lower bits of digital representations. In practice, however, it is not possible to define a fixed envelope width that satisfactorily separates high and low-energy components due to the variability found in real-world signals.

The dynamic envelope autocorrelation described above keeps track of the maximum level found in the signal in the past short history to adaptively determine the amount of downshift (and hence the signal envelope width). With minimal computational overhead, the dynamic envelope autocorrelation eliminates the influence of low-energy tonal components resulting from, e.g., quiet background music or noise mixed with speech. Moreover, the dynamic envelope proves to be extremely useful in situations of dialogs frequently intermingled with pauses during which the background music or noise becomes prevalent.

Figure 4A:
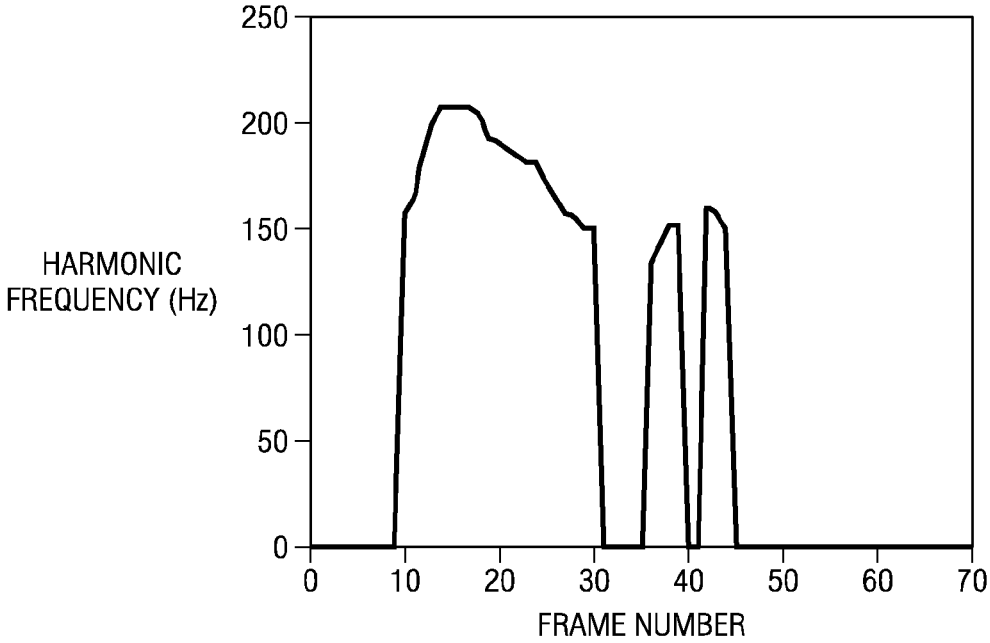
FIGS. 4A and 4B show experimental results in accordance with one or more embodiments of the invention.
Figure 4B:
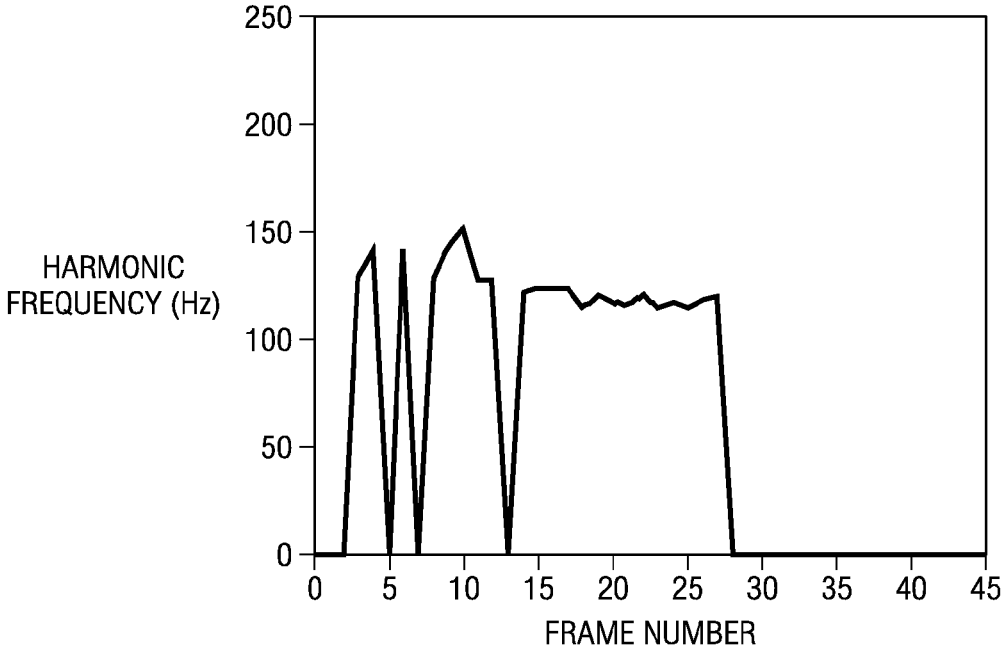

FIGS. 4A and 4B show two examples of predominant fundamental frequency extraction using a method for dynamic envelope autocorrelation as described herein. FIG. 4A shows a predominant fundamental frequency contour extracted from noisy male speech and FIG. 4B shows a predominant fundamental frequency contour extracted from a single piano note. Note that the method does not reliably detect a harmonic frequency at the attack portion of the piano note, resulting in discontinuities at the beginning of the contour. Quickly, however, the method correctly converges to the predominant fundamental frequency. Note also the relatively flat predominant fundamental frequency contour of the piano note (as expected).

Figure 5:
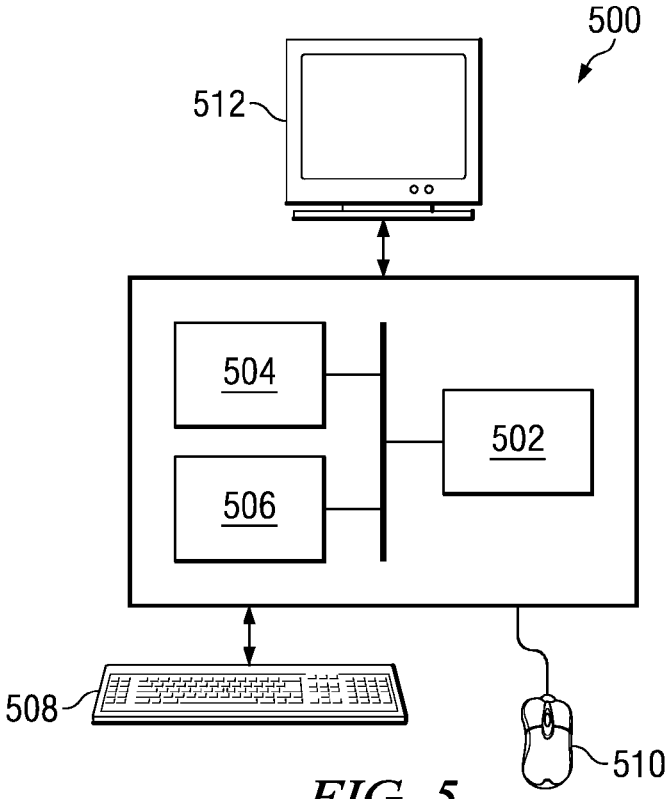
FIG. 5 shows an illustrative digital system in accordance with one or more embodiments of the invention.

As previously mentioned, embodiments of the fundamental frequency detection methods and systems described herein may be implemented on virtually any type of digital system. Further examples include, but are not limited to a desk top computer, a laptop computer, a handheld device such as a mobile (i.e., cellular) phone, a personal digital assistant, a digital camera, an MP3 player, an iPod, etc). Further, embodiments may include a digital signal processor (DSP), a general purpose programmable processor, an application specific circuit, or a system on a chip (SoC) such as combinations of a DSP and a RISC processor together with various specialized programmable accelerators. For example, as shown in FIG. 5, a digital system (500) includes a processor (502), associated memory (504), a storage device (506), and numerous other elements and functionalities typical of today's digital systems (not shown). In one or more embodiments of the invention, a digital system may include multiple processors and/or one or more of the processors may be digital signal processors. The digital system (500) may also include input means, such as a keyboard (508) and a mouse (510) (or other cursor control device), and output means, such as a monitor (512) (or other display device). The digital system ((500)) may also include an image capture device (not shown) that includes circuitry (e.g., optics, a sensor, readout electronics) for capturing digital images. The digital system (500) may be connected to a network (514) (e.g., a local area network (LAN), a wide area network (WAN) such as the Internet, a cellular network, any other similar type of network and/or any combination thereof) via a network interface connection (not shown). Those skilled in the art will appreciate that these input and output means may take other forms.

Further, those skilled in the art will appreciate that one or more elements of the aforementioned digital system (500) may be located at a remote location and connected to the other elements over a network. Further, embodiments of the invention may be implemented on a distributed system having a plurality of nodes, where each portion of the system and software instructions may be located on a different node within the distributed system. In one embodiment of the invention, the node may be a digital system. Alternatively, the node may be a processor with associated physical memory. The node may alternatively be a processor with shared memory and/or resources.

Software instructions to perform embodiments of the invention may be stored on a computer readable medium such as a compact disc (CD), a diskette, a tape, a file, or any other computer readable storage device. The software instructions may be a standalone program, or may be part of a larger program (e.g., a photo editing program, a web-page, an applet, a background service, a plug-in, a batch-processing command). The software instructions may be distributed to the digital system (500) via removable memory (e.g., floppy disk, optical disk, flash memory, USB key), via a transmission path (e.g., applet code, a browser plug-in, a downloadable standalone program, a dynamically-linked processing library, a statically-linked library, a shared library, compilable source code), etc. The digital system (500) may access a digital image by reading it into memory from a storage device, receiving it via a transmission path (e.g., a LAN, the Internet), etc.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims. It is therefore contemplated that the appended claims will cover any such modifications of the embodiments as fall within the true scope and spirit of the invention.

What is claimed is:

1. A method of determining a predominant fundamental frequency of a frame of an audio signal, the method comprising:

finding a maximum absolute signal value in history data for the frame;

determining a number of bits for downshifting based on the maximum absolute signal value;

computing autocorrelations for the frame using signal values downshifted by the number of bits; and determining the predominant fundamental frequency using the computed autocorrelations.

2. The method of claim 1, wherein determining a number of bits further comprises subtracting a predetermined number from a number of bits of the maximum absolute signal value.

3. The method of claim 2, wherein the predetermined number is three.

4. The method of claim 1, wherein determining the predominant fundamental frequency further comprises determining a reciprocal of a smallest lag wherein an autocorrelation of the computed autocorrelations corresponding to the smallest lag exceeds a threshold.

5. The method of claim 4, wherein the threshold is an empirically determined percentage of a maximum autocorrelation of the frame.

6. The method of claim 1, wherein determining the predominant fundamental frequency further comprises determining a reciprocal of an absolute difference between two largest lags wherein autocorrelations of the computed autocorrelations corresponding to the two largest lags exceed a threshold.

7. The method of claim 6, wherein the threshold is an empirically determined percentage of a maximum autocorrelation of the frame.

8. The method of claim 7, wherein the empirically determined percentage is twenty percent.

9. The method of claim 1, wherein the history data is one hundred to two hundred frames.

10. The method of claim 1, wherein the method is executed on a digital signal processor configured for multi-channel audio decoding and post-processing.

11. A digital system for determining a predominant fundamental frequency of a frame of an audio signal, the digital system comprising:

a digital signal processor; and a memory storing software instructions, wherein when executed by the digital signal processor, the software instructions cause the digital system to perform a method comprising:

finding a maximum absolute signal value in history data for the frame;

determining a number of bits for downshifting based on the maximum absolute signal value;

computing autocorrelations for the frame using signal values downshifted by the number of bits; and determining the predominant fundamental frequency using the computed autocorrelations.

12. The digital system of claim 11, wherein determining a number of bits further comprises subtracting a predetermined number from a number of bits of the maximum absolute signal value.

13. The digital system of claim 12, wherein the predetermined number is three.

14. The digital system of claim 11, wherein determining the predominant fundamental frequency further comprises finding at least one autocorrelation of the computed autocorrelations that exceeds a threshold based on a maximum autocorrelation of the frame.

15. The digital system of claim 14, wherein the threshold is an empirically determined percentage of the maximum autocorrelation.

16. The digital system of claim 15, wherein the empirically determined percentage is twenty percent.

17. The digital system of claim 11, wherein determining the predominant fundamental frequency further comprises determining a reciprocal of an absolute difference between two largest lags wherein autocorrelations of the computed autocorrelations corresponding to the two largest lags exceed a threshold based on a maximum autocorrelation of the frame.

18. A computer readable medium comprising executable instructions to determine a predominant fundamental frequency of a frame of an audio signal by:

finding a maximum absolute signal value in history data for the frame;

determining a number of bits for downshifting based on the maximum absolute signal value;

computing autocorrelations for the frame using signal values downshifted by the number of bits; and determining the predominant fundamental frequency using the computed autocorrelations.

19. The computer readable medium of claim 18, wherein determining a number of bits further comprises subtracting a predetermined number from a number of bits of the maximum absolute signal value.

20. The computer readable medium of claim 18, wherein determining the predominant fundamental frequency further comprises determining a reciprocal of an absolute difference between two largest lags wherein autocorrelations of the computed autocorrelations corresponding to the two largest lags exceed a threshold based on a maximum autocorrelation of the frame.

* * * * *